US006216923B1

(12) United States Patent
Cech

(10) Patent No.: US 6,216,923 B1
(45) Date of Patent: Apr. 17, 2001

(54) LIQUID POURING DEVICE

(76) Inventor: Jerry Edward Cech, 4383 E. Mt. Morris, Mt. Morris, MI (US) 48458

( * ) Notice: Subject to any disclaimer, the term of this patent is extended or adjusted under 35 U.S.C. 154(b) by 0 days.

(21) Appl. No.: 09/431,631

(22) Filed: Nov. 2, 1999

(51) Int. Cl.[7] ..... B65D 47/00
(52) U.S. Cl. ..... 222/544; 215/232
(58) Field of Search ..... 222/544, 467, 222/465.1; 215/232

(56) References Cited

U.S. PATENT DOCUMENTS 1,475,600 * 11/1923 Schling ..... 222/544
3,667,638 * 6/1972 Cambio, Jr. ..... 215/32
4,368,826 * 1/1983 Thompson ..... 215/100
5,706,974 * 1/1998 Murdick et al. ..... 220/735

* cited by examiner

*Primary Examiner*—Kevin Shaver
*Assistant Examiner*—Melvin A. Cartagena

(57) ABSTRACT

A liquid pouring device that allows oil to be poured into an engine without the spillage and waste commonly accompanying liquid pouring from conventional plastic oil bottles. By use of the liquid pouring device, the user places the device up against the outlet of the oil bottle thereby preventing the flow of oil from the bottle. The oil bottle is then turned upside down and in close proximity to the engine oil port. Once the oil bottle is positioned properly, the liquid pouring device is removed and oil is allowed to flow into the engine oil port with no spillage.

4 Claims, 2 Drawing Sheets

LIQUID POURING DEVICE

BACKGROUND—FIELD OF INVENTION

This invention relates to an improved liquid pouring device. More specifically this invention relates to a hand held liquid pouring device that aids the user in pouring oil from a typical oil can/bottle into a typical engine oil filler hole, thereby eliminating the occurrence of oil spillage onto the engine block and/or ground.

BACKGROUND—DESCRIPTION OF PRIOR ART

Many engine designs have placed the oil filler hole in such a location that an owner is required to use a large cumbersome funnel to pour oil into the engine. In the days of large cylindrical paper and metal oil cans, the user had to insert a large metallic spout into the can that allowed a user to directly insert the oil can into the engine with little or no oil spillage. These spouts were metallic and would pierce the oil can top when inserted into the can. Within the past 10 years however, the oil industry has switched over to plastic oil cans that incorporate a small neck and a small hole from which the oil pours. These metallic oil spouts are no longer useable. To pour the oil into the engine with this new oil can, the user must first insert a funnel into the engine oil hole. In the alternative, the user could try to pour the oil directly from the oil can into the engine oil hole. Both of these current approaches have considerable drawbacks. The use of the funnel reduces the chance of spillage on the engine, but once the funnel is removed from the engine, any residual oil still in the funnel will continue to flow with gravity and cause spillage. Attempting to pour the oil without the use of a funnel almost always results in spillage onto the engine and the floor. An improved device that allows the user to pour oil from these new oil cans to the engine without spillage is needed.

OBJECTS AND ADVANTAGES

Accordingly, several objects and advantages of the present invention are to provide an improved liquid pouring device.

It is a further object of this invention to provide an liquid pouring device which effectively allows for the pouring of a desired amount of oil from plastic oil bottles into the oil receiving port of an engine without spillage.

It is still a further object of this invention to provide an improved liquid pouring device which is drip free and which can accommodate different sized oil receiving ports on engines through the use of a easily removable cap-like means.

It is another object of the present invention to provide an improved liquid pouring device which allows the user to control the exact starting and stopping of the oil flow from the can into the engine without the need to touch any portion of the device that has contacted the oil, thereby keeping the user clean of oil.

The foregoing and other objects, features and advantages of this invention will be apparent from the following more particular description of the preferred embodiments of this invention, as illustrated in the accompanying drawings.

DRAWING FIGURES

REFERENCE NUMERALS IN DRAWINGS

10—improved liquid pouring device
12—blocking cap
14—vertical member
16—handle
18—oil bottle
20—hole
22—oil bottle outlet
24—engine oil port

DESCRIPTION—FIGS. 1–2

Figure 1:
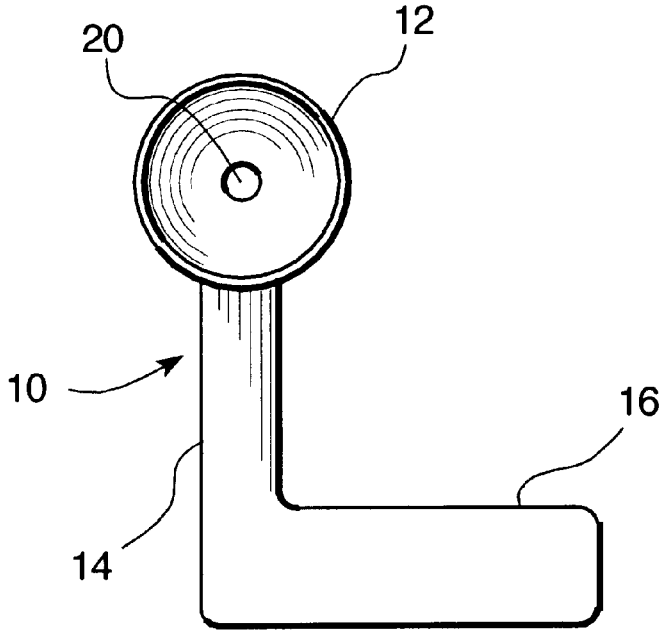
FIG. 1 is a plan view of the improved liquid pouring device.
Figure 2:
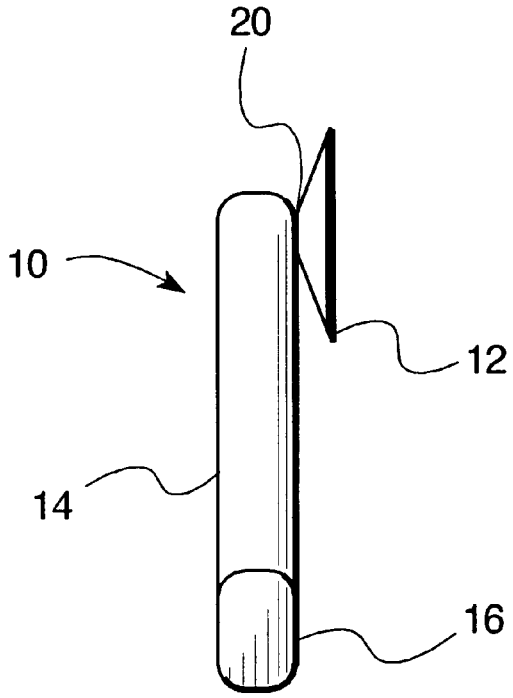
FIG. 2 is a side view of the improved liquid pouring device.
Figure 3:
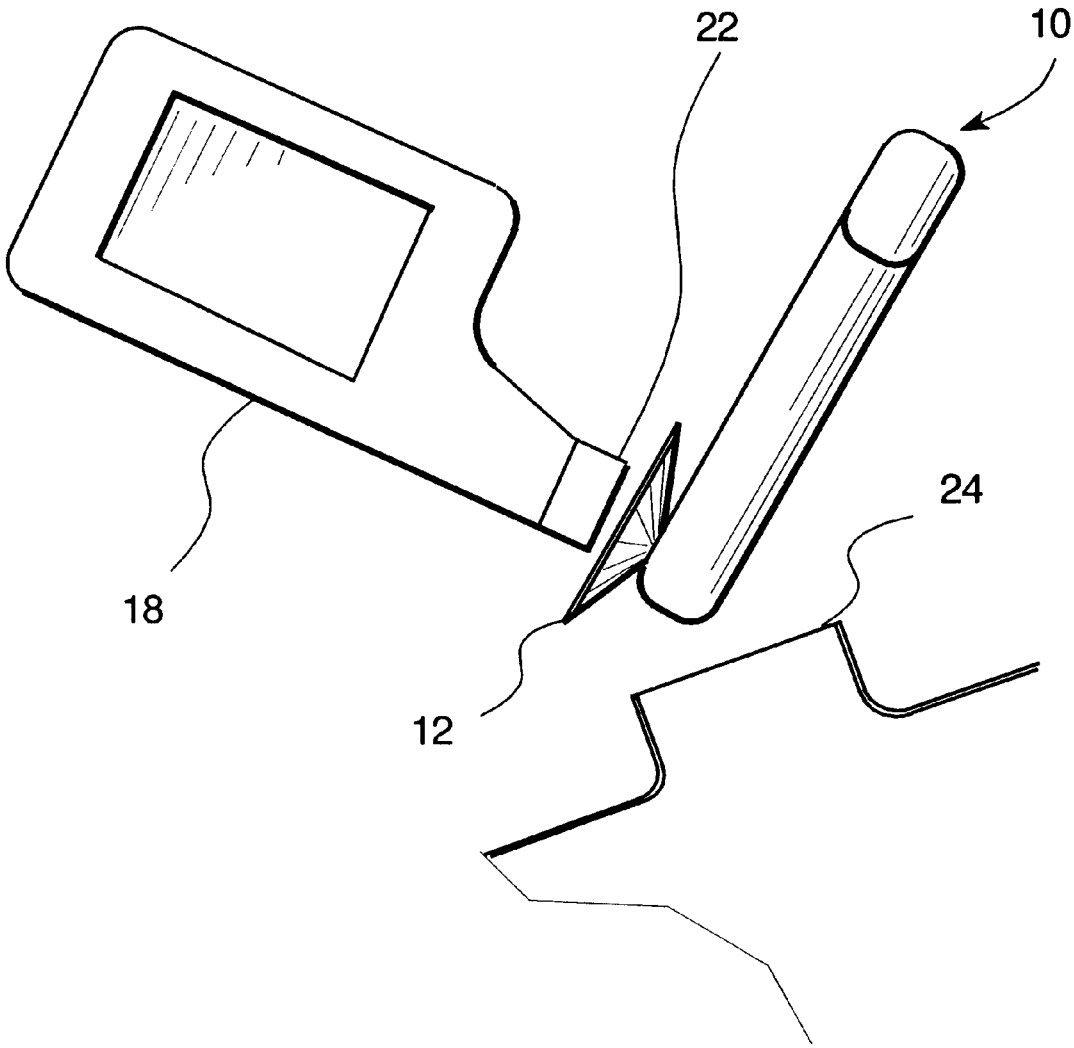
FIG. 3 is a side view of the improved liquid pouring device as located near the opening of a typical plastic oil can.

Referring now to FIG. 1, FIG. 2 and FIG. 3, a preferred embodiment improved liquid pouring device 10 is generally shown. The improved liquid pouring device 10 is comprised of a vertical member 14 having a predetermined length and cross section. Located at the top distal end of the vertical member 14 is a hole 20 with a blocking cap 12 rigidly inserted into the hole 20. The blocking cap 12 protrudes from the vertical member 14 and is circular in shape, the diameter of the blocking cap 12 being of a predetermined size to completely cover the opening of a typical plastic oil bottle 18. Rigidly affixed to the lower distal end and protruding perpendicular from the vertical member 14 is a handle 16. The handle 16 is similar in cross section to the vertical member 14, having a predetermined length for comfortable interface and use by a human hand. The handle 16 allows a person to place the improved liquid pouring device 10, specifically the blocking cap 12, up against the oil bottle outlet 22, thereby preventing the flow of oil from the oil bottle 18. When the blocking cap 12 is removed from the oil bottle outlet 22, oil is allowed to flow into the engine oil port 24, thereby eliminating the spillage of oil and the need for the human hand to touch surfaces that have been soiled with oil.

OPERATION

Referring to FIGS. 1 and 2, the operation of the improved liquid pouring device 10 is very simple and straightforward. The user grips the improved liquid pouring device 10 by grasping the handle 16 and further orients the vertical member 14 so that the blocking cap 12 is completely covering and blocking the oil bottle outlet 22 of the oil bottle 18. With the improved liquid pouring device 10 held in this relative position, the user lowers and rotates the oil bottle 18 to interface with the engine oil port 24. As the improved liquid pouring device 10 is positioned close to the engine oil port 24, the handle 16 is turned and pulled away so that the blocking cap 12 is removed from the path of the oil flow from the oil bottle outlet 22. As oil starts to flow from the oil bottle 18 into the engine oil port 24, the oil bottle 18 is inserted fully into the engine oil port 24, thereby eliminating the occurrence of oil spillage.

To stop the flow of oil from the oil bottle 18, the process is reversed. The oil bottle 18 is removed from the engine oil port 24 and the blocking cap 12 is placed up against the oil bottle outlet 22, completely blocking and preventing the further flow of oil from the oil bottle 18. This relative position is maintained while the user removes the oil bottle 18 and brings the oil bottle 18 to a full upright position.

SUMMARY, RAMIFICATIONS AND SCOPE

Accordingly, the reader will see that an improved liquid pouring device is shown that allows the user to quickly and neatly pour oil from today's plastic oil bottles. Spillage and leakage is prevented and the user is kept clean while pouring the oil. The device is simple to use, inexpensive, and easily stored in a vehicle glove box or storage bin.

Although the description above contains many specifications, these should not be construed as limiting the scope of the invention but as merely providing illustrations of some of the presently preferred embodiments of this invention. For example, this device could easily be made from stamped sheet metal thereby the structure would look visually different than those depicted. Thus, the scope of the invention should be determined by the appended claims and their legal equivalents, rather than by the examples given.

I claim:

1. A liquid pouring device comprising, a. a handle with a predetermined cross-section and length to comfortably interface with a human hand, thereby allowing the liquid pouring device to be positioned and manipulated by a user;

b. a vertical member of a predetermined length rigidly affixed and protruding approximately perpendicular to a lower distal end of said handle, said vertical member being made from the same material and cross-section of said handle;

c. a hole located at a top distal end of said vertical member, said hole being appropriately sized for the rigid insertion of a blocking cap, said blocking cap having a circular configuration and protruding from said vertical member, said blocking cap having a predetermined diameter thereby having a predetermined surface area to adequately obscure and cover an oil bottle outlet, thereby preventing the flow of oil from a typical oil bottle.

2. The liquid pouring device of claim 1, wherein said blocking cap is made from a clear rubber material.

3. The liquid pouring device of claim 1, wherein said liquid pouring device is made from aluminum.

4. The liquid pouring device of claim 1 wherein the liquid pouring device is made from a colored thermoplastic.

* * * * *